US008474914B2

(12) United States Patent
Chen et al.

(10) Patent No.: US 8,474,914 B2
(45) Date of Patent: Jul. 2, 2013

(54) ARMREST ADJUSTMENT DEVICE

(75) Inventors: Te-Chun Chen, Taoyuan (TW); Jing-Yi Lin, Yuanli Township, Miaoli County (TW)

(73) Assignee: ATec International Team Co., Ltd., Taoyuan, Taoyuan County (TW)

( * ) Notice: Subject to any disclaimer, the term of this patent is extended or adjusted under 35 U.S.C. 154(b) by 183 days.

(21) Appl. No.: 13/172,582

(22) Filed: Jun. 29, 2011

(65) Prior Publication Data

US 2012/0025584 A1 Feb. 2, 2012

(30) Foreign Application Priority Data

Jul. 30, 2010 (TW) ..... 99214703 U
Mar. 24, 2011 (TW) ..... 100205292 U

(51) Int. Cl.
*A47C 7/54* (2006.01)

(52) U.S. Cl.
USPC ..... 297/411.37; 297/411.35

(58) Field of Classification Search
USPC ..... 297/411.2, 411.35, 411.37
See application file for complete search history.

(56) References Cited

U.S. PATENT DOCUMENTS 7,188,907 B1 * 3/2007 Lai ..... 297/411.35
7,367,628 B1 * 5/2008 Tsai ..... 297/411.35
7,387,341 B1 * 6/2008 Tsai ..... 297/411.35
2006/0238011 A1 * 10/2006 Bedford et al. ..... 297/411.35

* cited by examiner

*Primary Examiner* — Milton Nelson, Jr.
(74) *Attorney, Agent, or Firm* — Muncy, Geissler, Olds & Lowe, PLLC

(57) ABSTRACT

An armrest adjustment device includes an armrest arranged at a top surface of an armrest support. The lower part of the armrest support is connected to a chair seat. The armrest can be adjusted to move forward and backward in relation to the chair seat. A first component is mounted in the armrest. The first component is assembled with and fixed on the armrest support so that the armrest can be moved forward and backward in relation to the first component. Moreover, a second component is arranged between the armrest and the armrest support. Instead of the first component, the second component is assembled with and fixed on the armrest support. Thus the armrest is moved in the left/right direction in relation to the second component.

11 Claims, 11 Drawing Sheets

ARMREST ADJUSTMENT DEVICE

BACKGROUND OF THE INVENTION

The present invention relates to an armrest adjustment device, especially to an armrest adjustment device that enables an armrest moving horizontally toward different directions. Moreover, the armrest adjustment is with simple structure and easy operation.

There are various designs of armrests available now. In order to make sitting more comfortable, the armrest can be adjusted in different directions according to figure of people sit in chairs.

Generally, an armrest consists of an armrest and an armrest support. The armrest is arranged at a top surface of the armrest support while the armrest support is fastened and fixed on the left side and the right side of a chair seat. The armrest adjustment involves adjusting the width of the armrest in the horizontal direction and the height of the armrest in the vertical direction. A horizontal adjustment part is for sliding the armrest forward or backward or rotating the armrest and usually is disposed on the armrest. A height adjustment part is for adjusting height of the armrest and is arranged at the armrest support. Refer to US Pat. Pub. No. 2008/0084103, an armrest having a rotational, longitudinal and lateral adjustment mechanism is revealed. However, the armrest has many components and complicated structure. Thus the assembling of the armrest is difficult and the production cost is high. This is not beneficial to mass production and market competitiveness. There is great room for improvement.

SUMMARY OF THE INVENTION

Therefore it is a primary object of the present invention to provide an armrest adjustment device includes an armrest arranged at a top surface of an armrest support. The lower part of the armrest support is connected to a chair seat. The armrest can be adjusted by fore/aft movement in relation to the chair seat. The movement of the armrest is stable, smooth and quiet and both the moving distance and the final position of the armrest can be controlled precisely.

It is another object of the present invention to provide an armrest adjustment device that is also moved in the left/right direction besides the forward and backward movement. The movement of the armrest is stable, smooth and quiet. Moreover, the moving distance and the stopped position of the armrest can be controlled precisely.

DETAILED DESCRIPTION OF THE PREFERRED EMBODIMENT

Embodiment One

Figure 1:
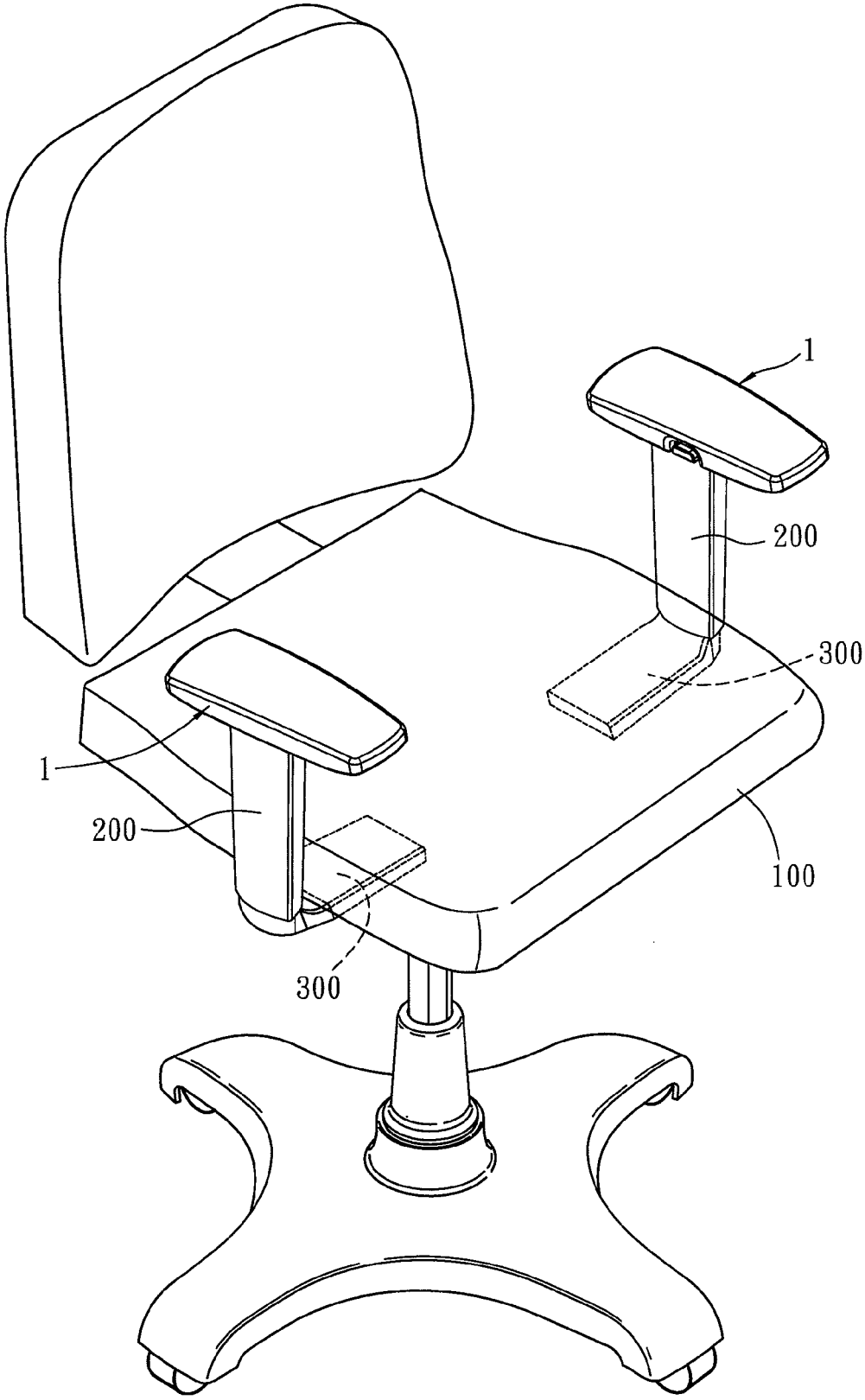
FIG. 1 is a schematic drawing showing a relative position between an armrest adjustment device of the present invention and a chair seat.
Figure 2:
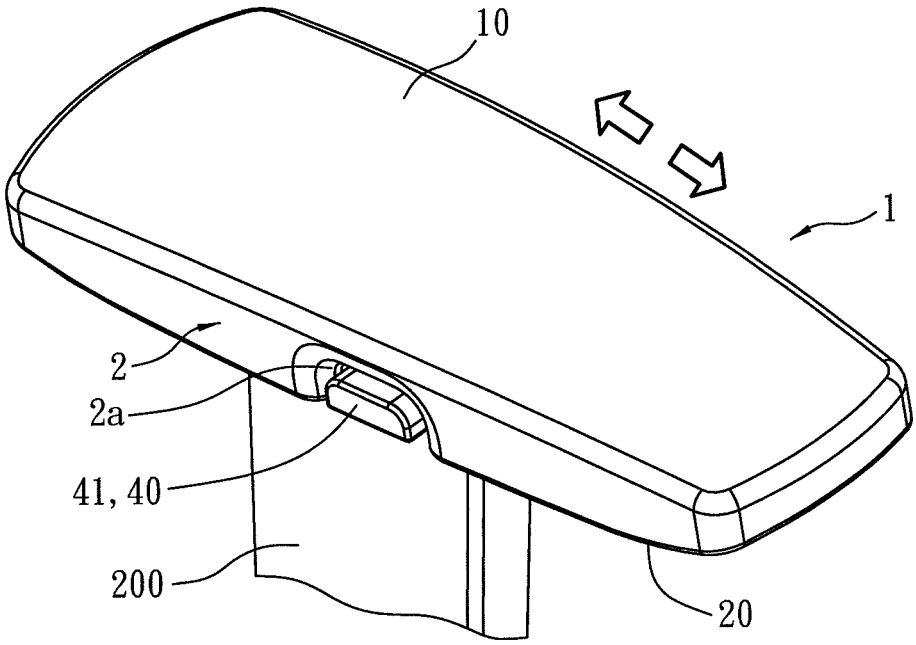
FIG. 2 is a perspective view of an embodiment of an armrest adjustment device according to the present invention.
Figure 3:
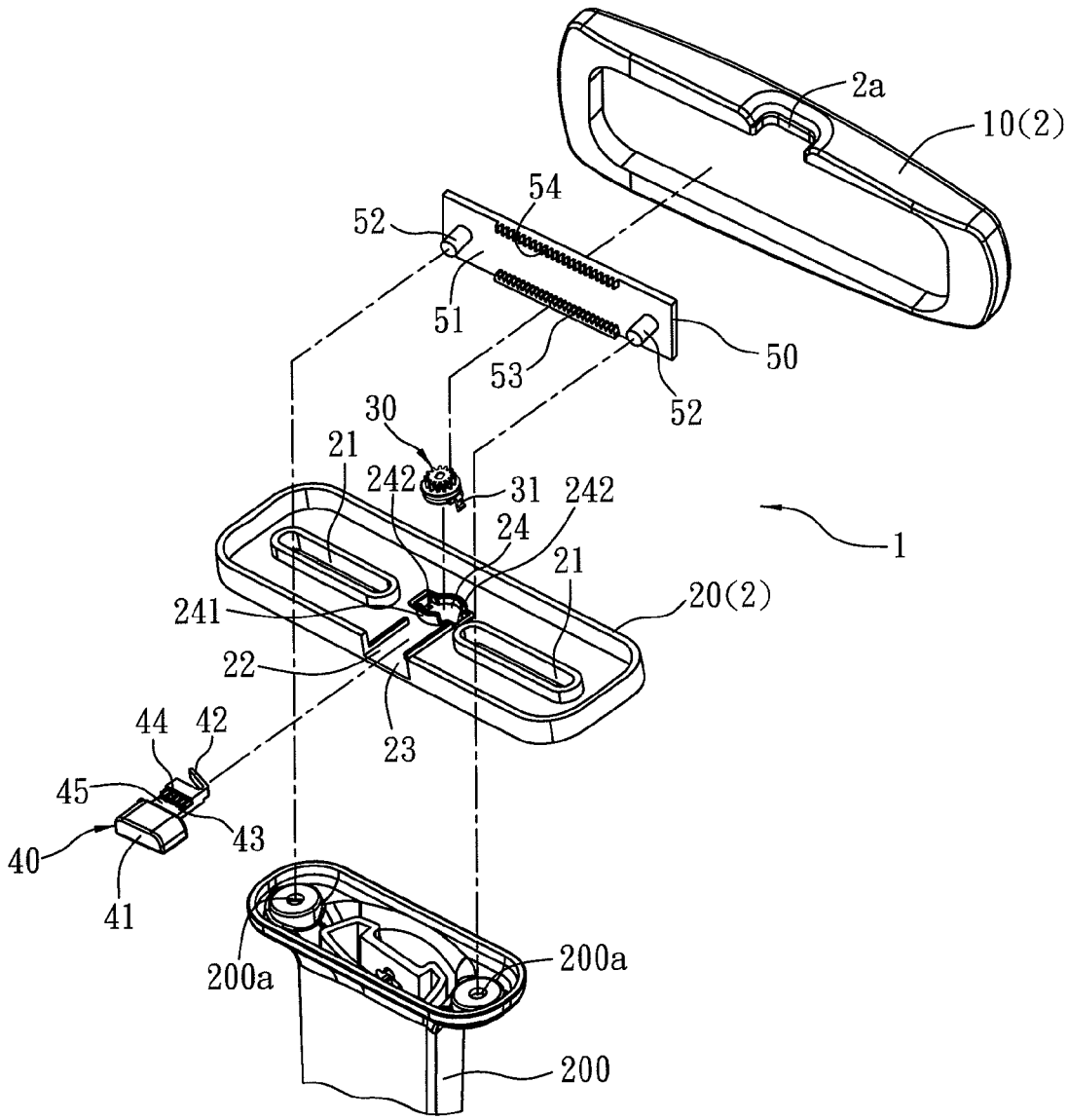
FIG. 3 is an explosive view of an embodiment of an armrest adjustment device according to the present invention.

Refer from FIG. 1 to FIG. 3, an armrest adjustment device of the present invention is disposed on each side of a chair seat 100 for resting a sitter's arm and adjusting fore/after(aft) position. The armrest adjustment device of the present invention includes an armrest 1 disposed on a top surface of an armrest support 200. A projecting block 300 extending from a lower part of the armrest support 200 is connected to a bottom surface of the chair seat 100. The armrest 1 can be moved forward and backward in relation to the armrest support 200, as the arrows indicated in FIG. 2. That means the armrest 1 is moved toward the front side or the rear side of the chair seat 100.

Refer to FIG. 3, the armrest 1 includes an armrest pad 10 and an armrest base 20, a damping part 30, a press member 40 and a first component 50. The armrest pad 10 and the armrest base 20 are assembled correspondingly to form an armrest body 2. A rectangular internal space for receiving related components is formed in the armrest body 2, between the armrest pad 10 and the armrest base 20. An opening **2*a* for mounting the press member 40 is arranged at one side of the armrest body 2**.

Two symmetrical slots 21 with the same length are arranged at a middle part of the armrest base 20 along the same direction of the fore/aft movement of the armrest 1. The length of the slot 21 is the maximum movement (travel) of the armrest base 20. A gap 22 is mounted on one side of the armrest base 20 and is aligned with the opening **2*a* of the armrest body 2. A sliding slot 23 is disposed on the armrest base 20, near the gap 22 so as to restrict movement of the press member 40 and prevent the press member 40 from falling out of the sliding slot 23. A mounting slot 24 for mounting and fixing the damping part 30 is arranged at an outer side of the armrest base 20. One side of the mounting slot 24, opposite to the gap 22 is arranged with a projecting piece 241 for stopping the press member 40**.

The damping part 30 is used to reduce impacts and vibrations for providing stability, such as a damping gear. The damping part 30 is assembled in the mounting slot 24 of the armrest base 20. Each of two sides of the damping part 30 is disposed with an elastic locking block 31 that is locked with and fixed into a locking slot 242 of the mounting slot 24.

A press part 41 for being pressed by users is on one end of the press member 40 while an elastic part 42 is arranged at the other side, opposite to the press part 41. Due to the elasticity of the elastic part 42, the press member 40 acts elastically after being pressed and released. The elastic part 42 can be a spring or a dome connected to and integrated with the press member 40 to simplify the structure. An open slot 43 with a proper size and an opening facing upwards is set between the press part 41 and the elastic part 42. At least one projective body 44 is disposed on a bottom of the open slot 43 near the side of the elastic part 42 while a channel 45 is formed on the bottom of the open slot 43 near the press part 41. The press member 40 is passed the gap 22 of the armrest base 20 to be mounted on the sliding slot 23 on the bottom of the armrest base 20 and the elastic part 42 is elastically against the projecting piece 241 on the side of the mounting slot 24 of the armrest base 20. While the press part 41 being pressed to push the press member 40 moving inward along the sliding slot 23, the elastic part 42 is compressed to lean against the projecting piece 241. When the press part 41 is released, the press member 40 is moved outward along the sliding slot 23 due to recovering elasticity of the elastic part 42.

The first component 50 is mounted inside the armrest body 2. A bottom surface 51 of the first component 50 is disposed with two posts 52, a positioning member 53 and a plurality of grooves 54 arranged at regular intervals. The two posts 52 are respectively arranged at a front part and a rear part on the bottom surface 51. The positioning member 53 can be a rack that is corresponding to and engaged with the damping part 30 while the groove 54 is corresponding to the open slot 43 of the press member 40 and is engaged with the projective body 44 of the open slot 43 for positioning.

While being assembled, each of the two posts 52 on the first component 50 passes the slot 21 on the middle of the armrest base 20 to be fixed into a hole 200*a* of the armrest support 200 correspondingly and the positioning member 53 is against the damping part 30. The groove 54 is correspondingly engaged with at least one projective body 44 of the open slot 43 of the press member 40.

The armrest pad 10, the armrest base 20, the damping part 30, and the press member 40 are assembled into a removable armrest 1 while the first component 50 and the armrest support 200 are fixed and connected. While being operated, the armrest 1 is moved forward and backward in relation to the first component 50 and the armrest support 200 and is moved stably by the positioning member 53 of the first component 50 against the damping part 30. The armrest 1 is positioned by the groove 54 engaged with the projective body 44. Thus the fore/aft movement and adjustment of the armrest 1 are achieved, as a front arrow and a rear arrow indicated in FIG. 2.

Figure 4:
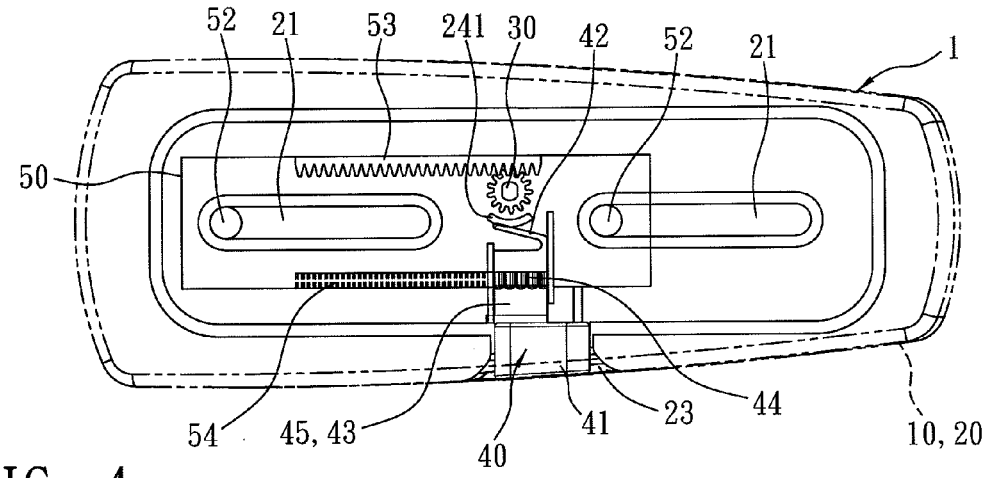
FIG. 4, FIG. 5, and FIG. 6 are schematic drawing showing movement of an armrest before and after adjustment.

Refer to FIG. 4, the figure shows a state of the armrest 1 before the adjustment.

Figure 5:
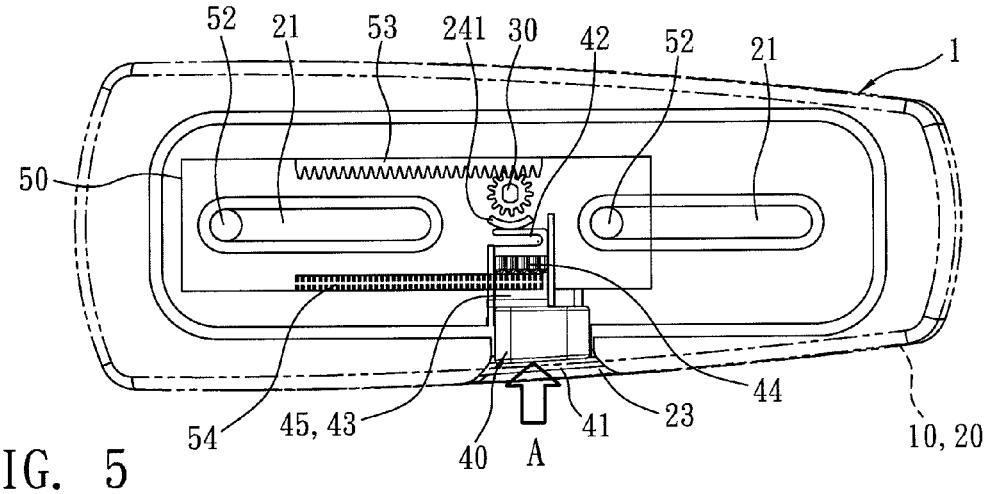

Refer to FIG. 5, the press part 41 of the press member 40 is pressed so that the press member 40 is moved inward along the sliding slot 23 of the armrest base 20, in the direction of the arrow A indicated. The elastic part 42 of the press member 40 is stopped by the projecting piece 241 on the side of the mounting slot 24 to become compressed. The slots 54 of the first component 50 are corresponding to the channel 45 of the open slot 43 for forward/backward movement and adjustment of the armrest 1.

Figure 6:
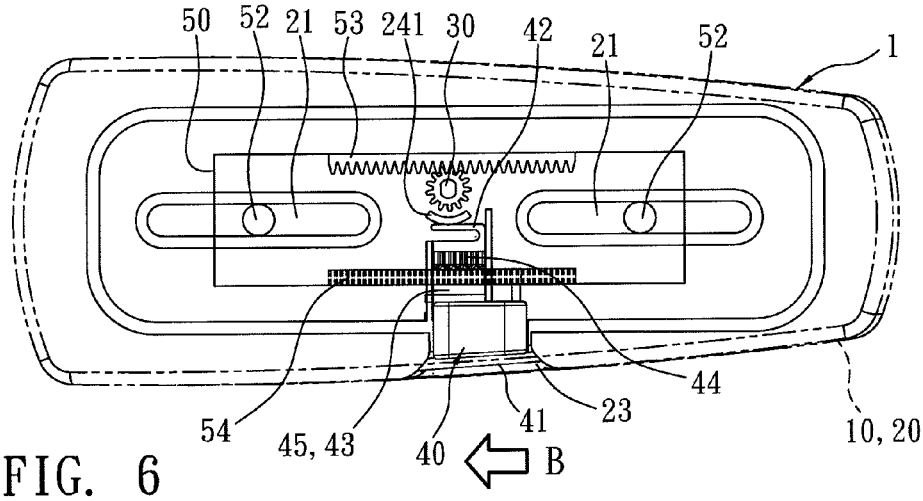

Refer to FIG. 6, then the armrest 1 is moved leftward, as the arrow B indicated, or moved into the opposite direction (not shown in figure). After the armrest 1 being moved to a proper position, the press member 40 is released and then moved outward along the sliding slot 23 of the armrest base 20 by the elastic recovery force of the elastic part 42. And the slot 54 of the first component 50 is engaged with the projective body 44 of the open slot 43. Thus the armrest 1 is stopped and positioned, as shown in the FIG. 4.

Moreover, when the armrest 1 is moved forward or backward, the movement is with damping effects due to the damping part 30 and the positioning member 53 of the first component 50. Thus the movement of armrest 1 is stable, smooth and quiet. Furthermore, the moving distance can be controlled precisely by the grooves 54 on the first component 50 engaged with the projective body 44 of the open slot 43.

Embodiment Two

Refer to FIG. 1, FIG. 7, FIG. 8, and FIG. 9, an armrest adjustment device is disposed on one side of a chair seat 100 and is for fore/aft and left/right movement of the armrest. The armrest adjustment device of the present invention includes an armrest 1 arranged at a top surface of an armrest support 200. A projecting block 300 extending from a lower part of the armrest support 200 is connected to a bottom surface of the chair seat 100. The armrest 1 can be moved forward/backward and leftward/rightward in relation to the armrest support 200, as the fore/aft, left and right arrows indicated in FIG. 7. That means the armrest 1 is moved toward the front side, the rear side, the left side and the right side of the chair seat 100.

The armrest 1 includes an armrest pad 10 and an armrest base 20, a damping part 30, a press member 40, a first component 50, a second component 60 and an adjustment member 70. The armrest pad 10 and the armrest base 20 are assembled correspondingly to form an armrest body 2. A rectangular internal space for receiving related components is formed in the armrest body 2, between the armrest pad 10 and the armrest base 20. An opening 2*a* for mounting the press member 40 is arranged at one side of the armrest body 2.

Two symmetrical slots 21 with the same length are arranged at a middle part of the armrest base 20 along the same direction of the fore/aft movement of the armrest 1. The length of the slot 21 is the maximum movement (travel) of the armrest base 20. A gap 22 is mounted on one side of the armrest base 20 and is aligned with the opening 2*a* of the armrest body 2. A sliding slot 23 is disposed on the armrest base 20, near the gap 22 so as to restrict movement of the press member 40 and prevent the press member 40 from falling out of the sliding slot 23. A receiving hole 25 for receiving the adjustment member 70 and corresponding to the gap 22 is disposed on the armrest base 20. A circular wall 251 is set around the receiving hole 25 and is used to stop the press member 40. A mounting slot 24 for mounting and fixing the damping part 30 is arranged at an outer side of the armrest base 20.

The damping part 30 is for reducing impacts and vibrations to provide stability, such as a damping gear. The damping part 30 is assembled over the mounting slot 24 of the armrest base 20. Each of two sides of the damping part 30 is disposed with an elastic locking block 31 that is locked with and fixed into a locking slot 242 of the mounting slot 24.

The adjustment member 70 is set in the receiving hole 25 of the armrest base 20, passing through the circular wall 251 of the receiving hole 25. At least one projective body 71 is disposed on the bottom of the adjustment member 70 and two symmetrical lugs 72 are arranged at an upper part of the adjustment member 70. The lug 72 is over the circular wall 251 of the receiving hole 25 and is including a slant part 721.

The press member 40 includes a press part 41 on one end and a slanted guide groove 46 on the other end thereof. The press part 41 is used to be pressed and the slanted guide groove 46 is corresponding to and assembled with the lug 72 of the adjustment member 70. The press member 40 is able to be moved horizontally by the slanted guide groove 46 and a slanted surface 721 of the lug 72 of the adjustment member 70 can be moved vertically within the slanted guide groove 46. An open slot 43 with a proper size and an opening facing upwards is set between the press part 41 and the slanted guide groove 46. At least one projective body 44 is disposed on a bottom of the open slot 43 near the side of the slanted guide groove 46 while a channel 45 is formed near the press part 41. An elastic part 80 is set and contacted elastically between the press member 40 and the receiving hole 25. The elastic part 80 can be a spring or a dome connected to and integrated with the press member 40 to simplify the structure. Thus the press member 40 can be moved elastically by the elasticity of the elastic part 80 while being pressed and released. The press member 40 passing the gap 22 of the armrest base 20 is arranged at the sliding slot 23 on the armrest base 20 and the lug 72 of the adjustment member 70 is assembled with the slanted guide groove 46 correspondingly. The elastic part 80 is elastically against the circular wall 251 of the receiving hole 25 of the armrest base 20.

The first component 50 is arranged inside the armrest body 2. A post 52 is disposed on a front part and a rear part respectively on a bottom surface 51 of the first component 50. A guiding block 55 is connected to a bottom end of the post 52. The bottom surface 51 of the first component 50 is further arranged with a positioning member 53 and a plurality of grooves 54 arranged at regular intervals. The positioning member 53 can be a rack that is corresponding to the damping part 30 while the groove 54 is corresponding to the open slot 43 of the press member 40 and is engaged with the projective body 44 of the open slot 43 for positioning. The first component 50 is further arranged with a long groove 56 that allows the adjustment member 70 moving upward freely. The long groove 56 is arranged along the same direction as that of the fore/aft movement of the armrest 1 and the length of the long groove 56 is the maximum movement (travel) of the armrest base 20. A positioning member 551 such as a rack is set on one side of the guiding block 55 and is engaged with the damping part 30 correspondingly.

Figure 9:
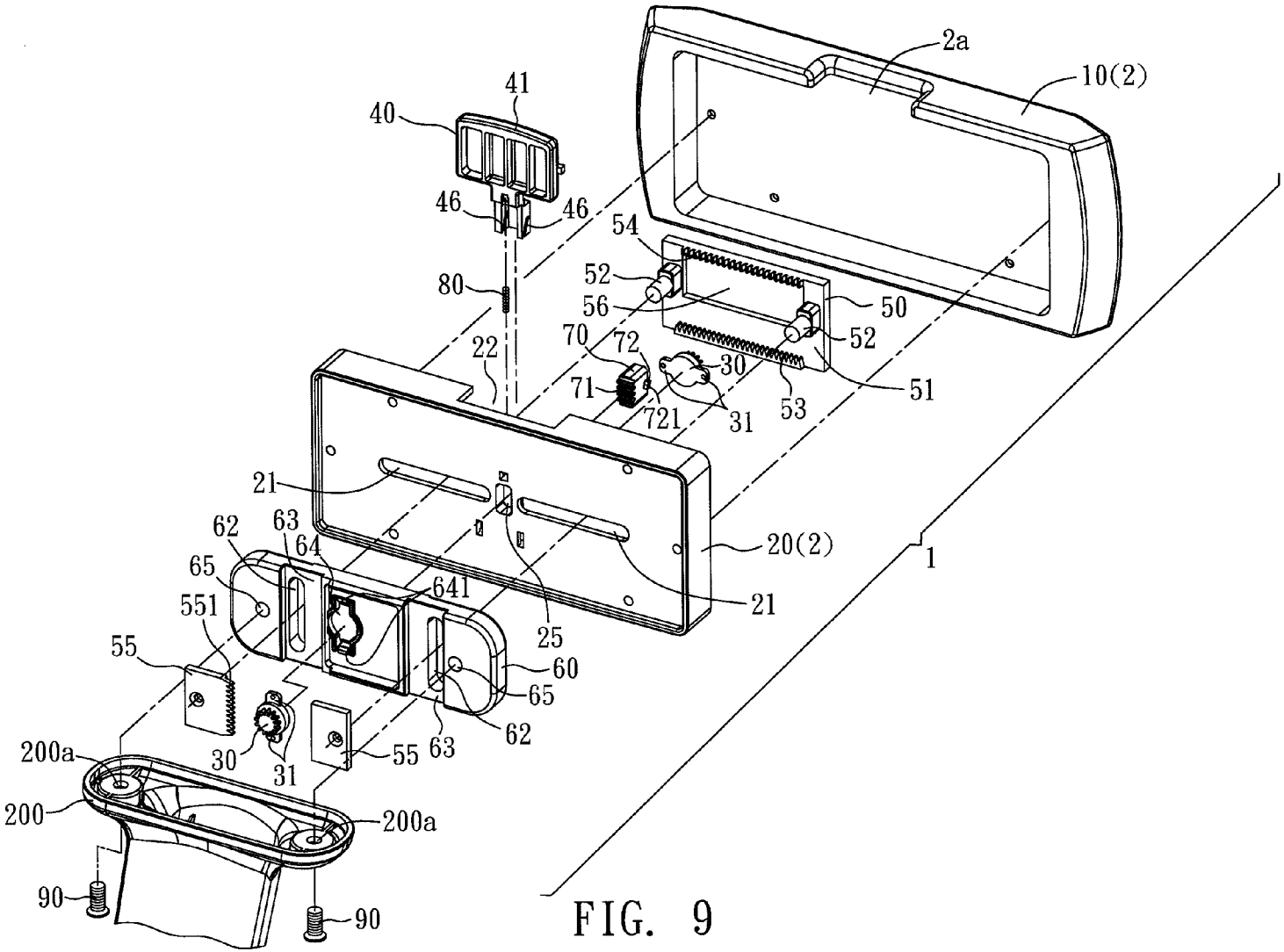
FIG. 9 is another explosive view of the embodiment shown in FIG. 8.

The second component 60 is disposed under the armrest body 2. The second component 60 is arranged with two threaded holes 65, a plurality of slots 61 arranged at regular intervals, two long grooves 62, two guiding slots 63 and a mounting slot 64. The two threaded holes 65 are respectively arranged at a front part and a rear part of the second component 60. The slots 61 engaged with the projective body 71 of the adjustment member 70 for positioning are on a middle part of the top surface of the second component 60. The long grooves 62 in the left/right direction are respectively disposed on a front part and a rear part of the top surface of the second component 60 while the guiding slots 63 penetrating from the left side to the right side are corresponding to the long grooves 62 and arranged at the bottom surface of the second component 60. As shown in FIG. 9, the mounting slot 64 is mounted on the bottom surface of the second component 60 and used for mounting and fixing a damping part 30. A locking block 31 is arranged at each of two sides of the damping part 30 symmetrically and is locked with and fixed into a locking slot 641 of the mounting slot 64.

While being assembled, each of the two posts 52 on the first component 50 passes the two slots 21 on the middle part of the armrest base 20 and the long groove 62 of the second component 60 and the guiding block 55 is connected to the bottom end of the post 52. The guiding block is able to move within the guiding slot 63 on the bottom surface of the second component 60 and the positioning member 53 is against a damping part 30 while the positioning member 551 is contacted with another damping part 30. The groove 54 is engaged with at least one projective body 44 of the open slot 43 of the press member 40. The plurality of slots 61 of the second component is engaged with at least one projective body 71 of the adjustment member 70. Moreover, a bolt 90 is passes the threaded hole 65 of the second component 60 to be assembled with and fixed on hole 200*a* of the armrest support 200.

When the press part 41 is pressed, an elastic part 80 is compressed and leaning against the circular wall 251 of the receiving hole 25 so as to make the press member 40 move inward along the sliding slot 23 and the adjustment member 70 is pushed to move upward and separate with the second component 60. While the press part 41 being released, the press member 40 is moved outward along the sliding slot 23 due to recovering elasticity of the elastic part 80. And the adjustment member 70 is moved downward to be engaged with the second component 60 correspondingly.

The armrest pad 10, the armrest base 20, the press member 40, the first component 50 and the adjustment member 70 are assembled into a removable armrest 1 while the first component 50 and the armrest support 200 are fixed and connected with each other. While being operated, the armrest 1 is moved forward and backward in relation to the second component 60, the first component 50 and the armrest support 200 and is moved stably by the positioning member 53 of the first component 50 against a damping part 30. The armrest 1 is positioned by the groove 54 engaged with the projective body 44 of the press member 40. Thus the fore/aft movement and adjustment of the armrest 1 are achieved. Moreover, the armrest 1 can be moved in the left/right direction in relation to the second component 60 and the armrest support 200 and the movement of the armrest 1 is stable due to the positioning member 551 of the guiding block 55 against another damping part 30. The moved armrest 1 is positioned by the slots 61 engaged with the projective body 71 of the adjustment member 70. Thus the armrest 1 is adjusted by being moved in the left/right direction, as the arrows indicated in FIG. 7.

Figure 7:
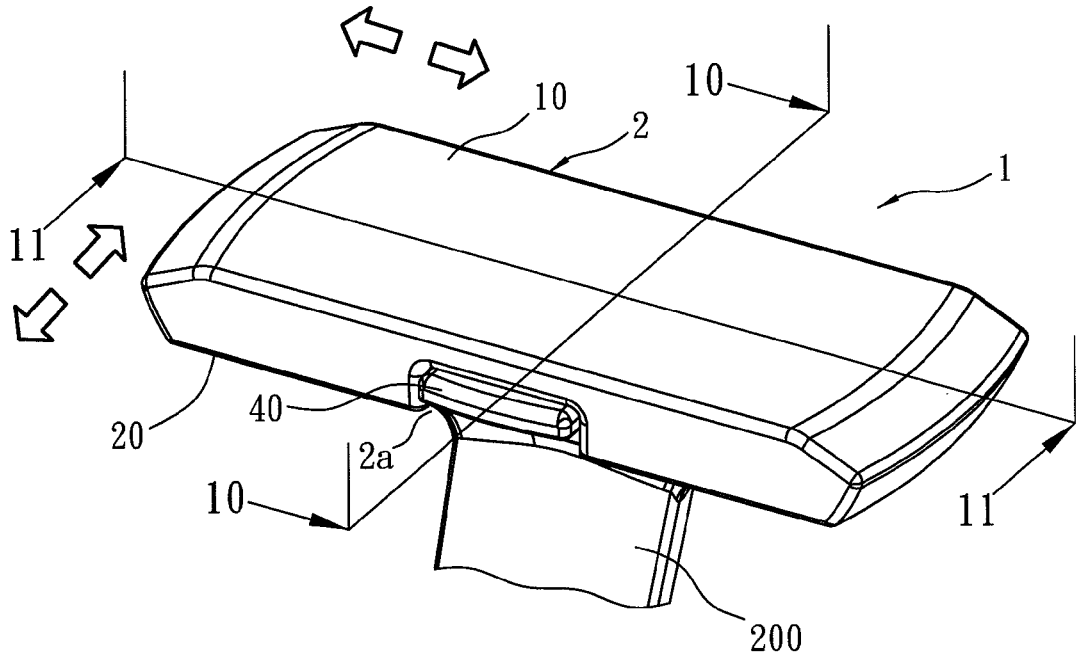
FIG. 7 is a perspective view of another embodiment of an armrest adjustment device according to the present invention.
Figure 8:
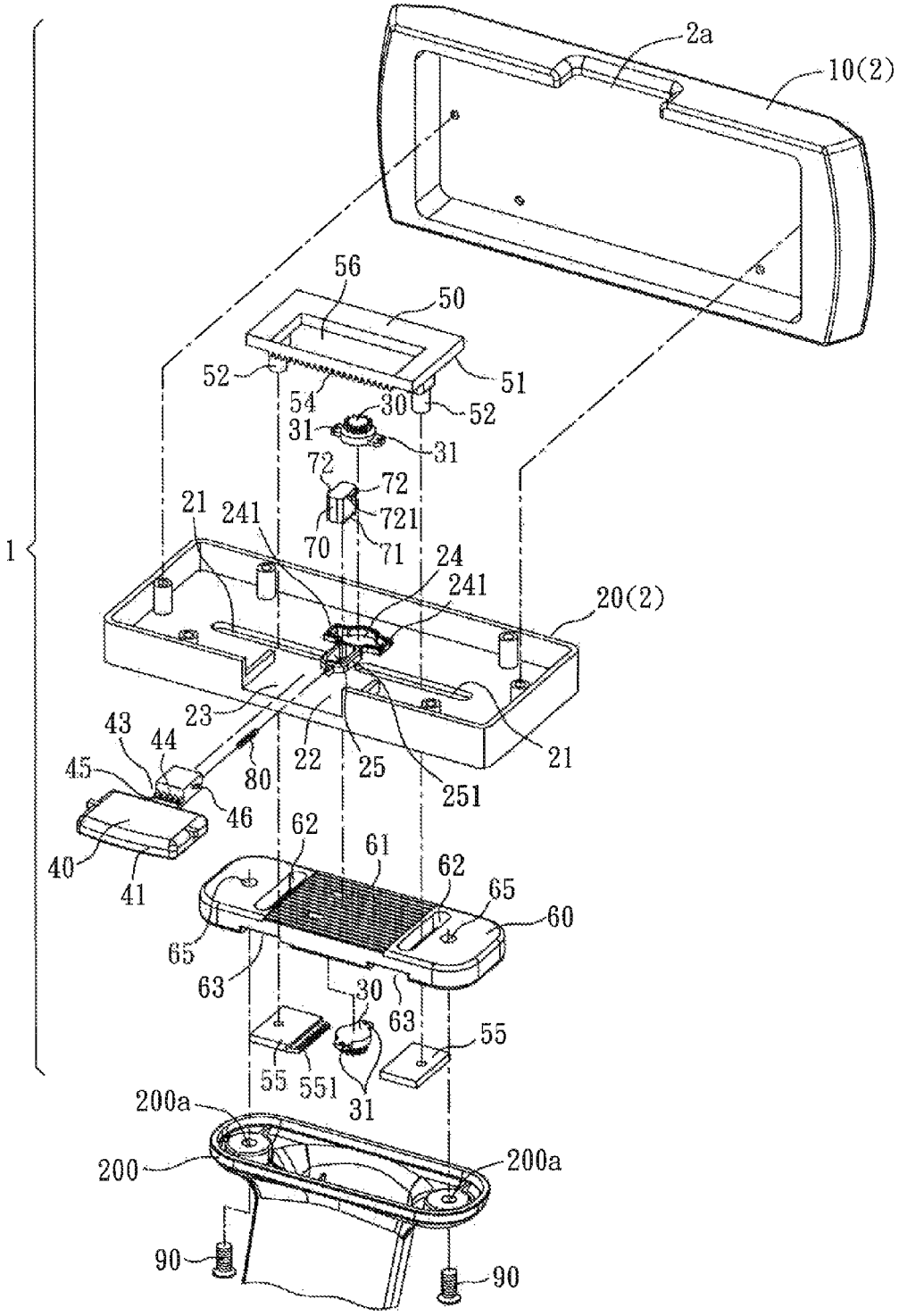
FIG. 8 is an explosive view of another embodiment of an armrest adjustment device according to the present invention.
Figure 10:
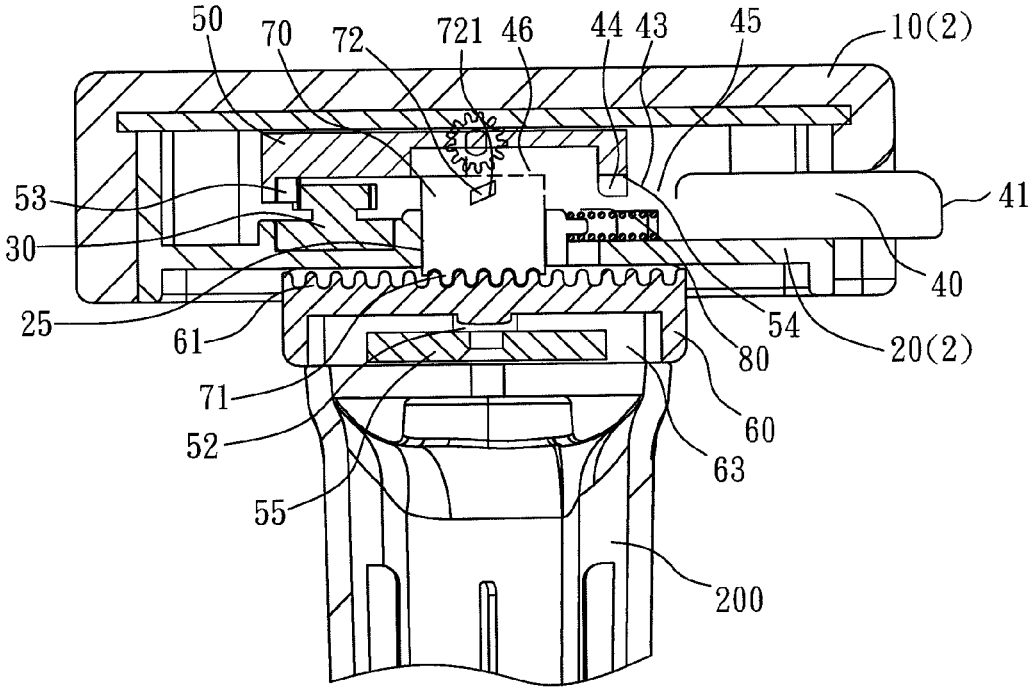
FIG. 10 is a partial cross sectional view of the embodiment in FIG. 7 along 10-10 line.
Figure 11:
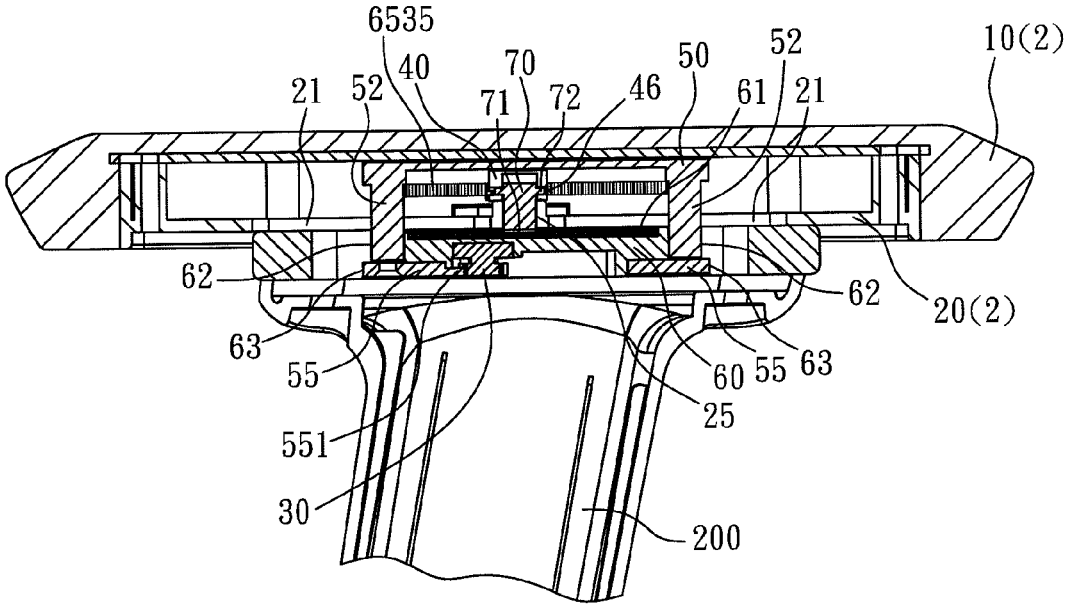
FIG. 11 is a partial cross sectional view of the embodiment in FIG. 7 along 11-11 line.

Refer to FIG. 10, a partial cross section of the embodiment in FIG. 7 along 10-10 line is revealed. A partial cross sectional view of the embodiment in FIG. 7 along 11-11 line is shown in FIG. 11. The two figures show the state of the armrest 1 of the armrest adjustment device before adjustment and movement.

Figure 12:
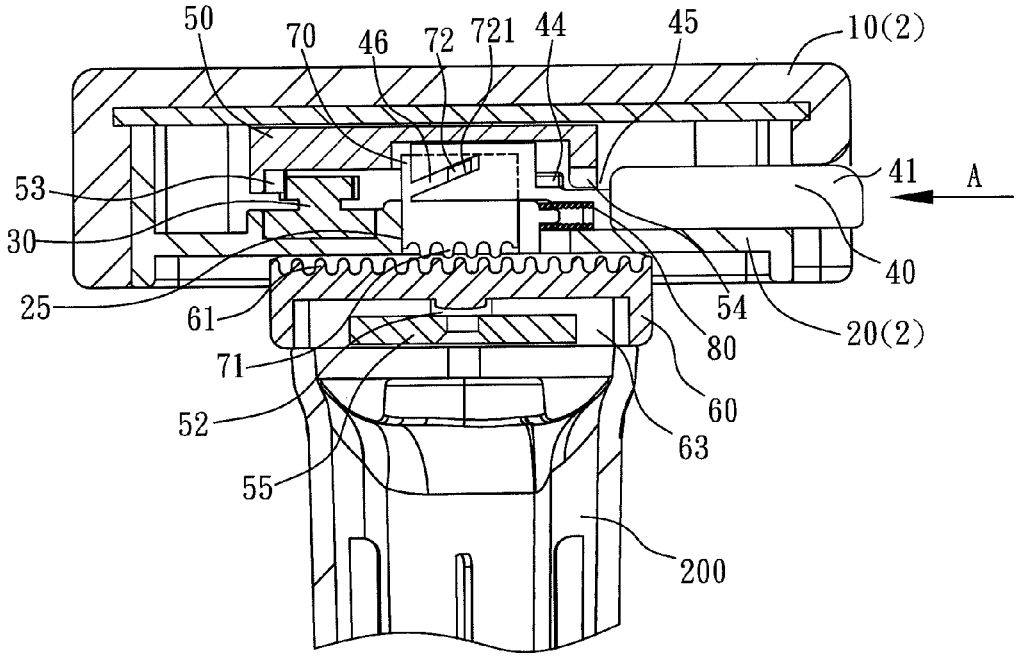
FIG. 12 and FIG. 13 are schematic drawings showing leftward/rightward movement of the embodiment in FIG. 10.
Figure 13:
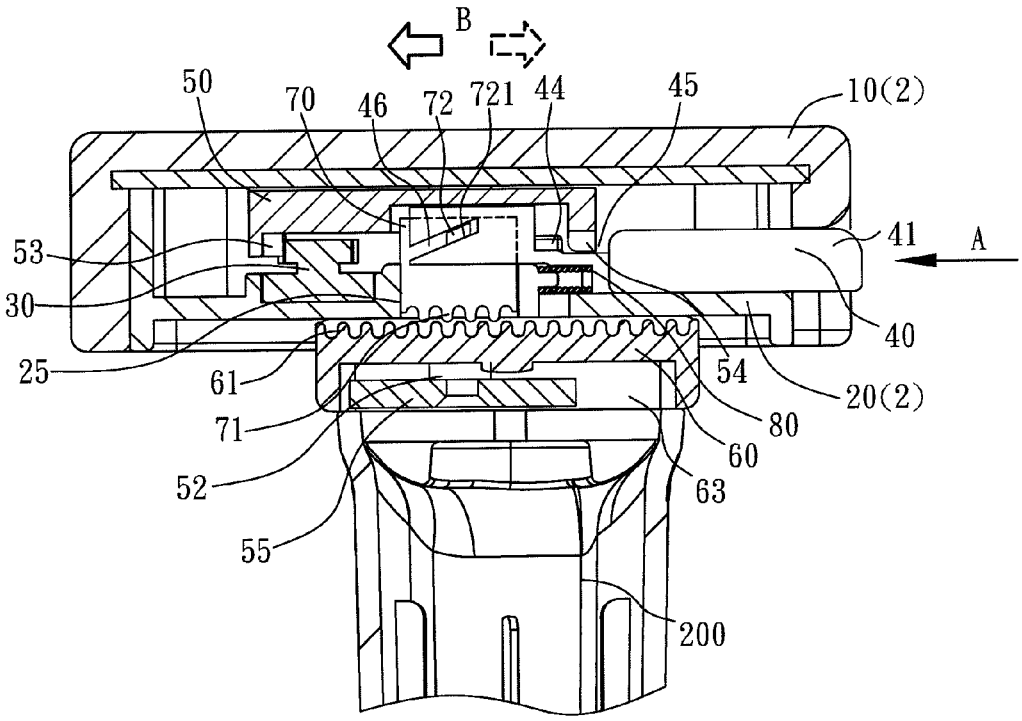

Refer to FIG. 12 and FIG. 13, the press part 41 of the press member 40 is pressed so that the press member 40 is moved inward along the sliding slot 23 of the armrest base 20, in the direction of the arrow A indicated. Thus the adjustment member 70 is driven to move upward and separated from the second component 60. As to the elastic part 80, it is stopped by the circular wall 251 of the receiving hole 25 to become compressed. The slots 54 of the first component 50 are corresponding to the channel 45 of the open slot 43 for leftward/rightward movement and adjustment of the armrest 1. As shown in FIG. 13, the armrest 1 is moved leftward, in the direction of the arrow B. The armrest 1 can also be moved to the opposite direction (the right side).

Figure 14:
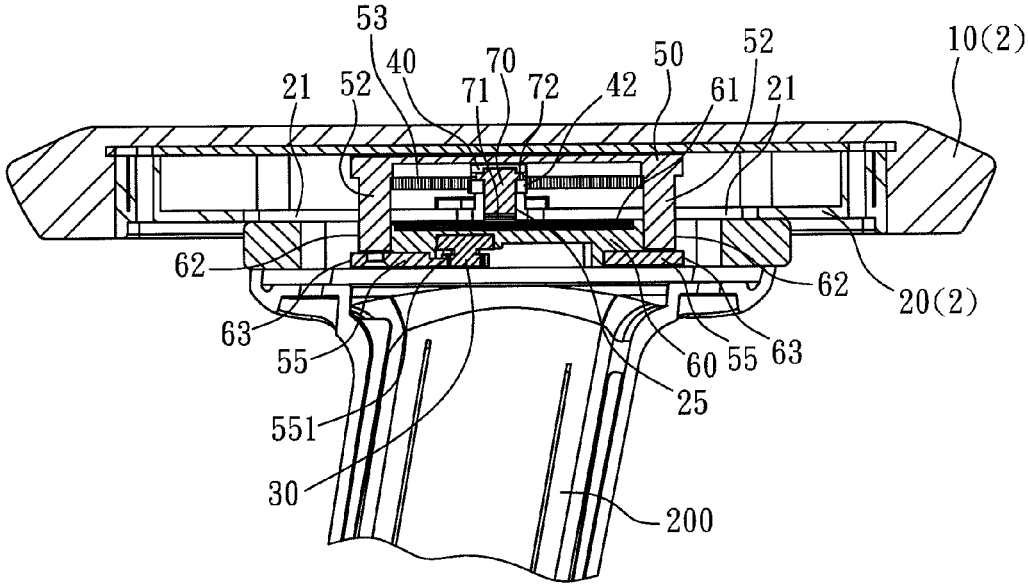
FIG. 14 and FIG. 15 are schematic drawings showing forward/backward movement of the embodiment in FIG. 11.
Figure 15:
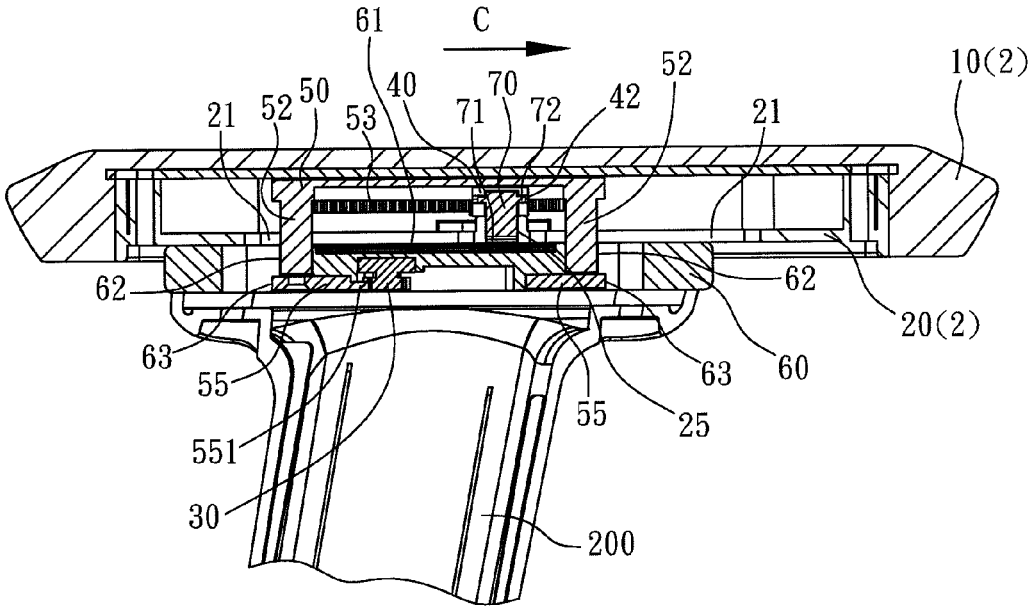

Refer to FIG. 14 and FIG. 15, the armrest 1 of the embodiment in FIG. 12 is moved rightward, in the direction of the arrow C. The armrest can also be moved to the opposite direction (not shown in figure). After the armrest 1 being moved to a proper position, the press member is released and moved outward along the sliding slot 23 of the armrest base 20 by elastic recovery force of the elastic part 80. And the plurality of slots 54 of the first component 50 are engaged with the projective body 44 of the open slot 43 so as to stop and position the armrest 1.

Figure 16:
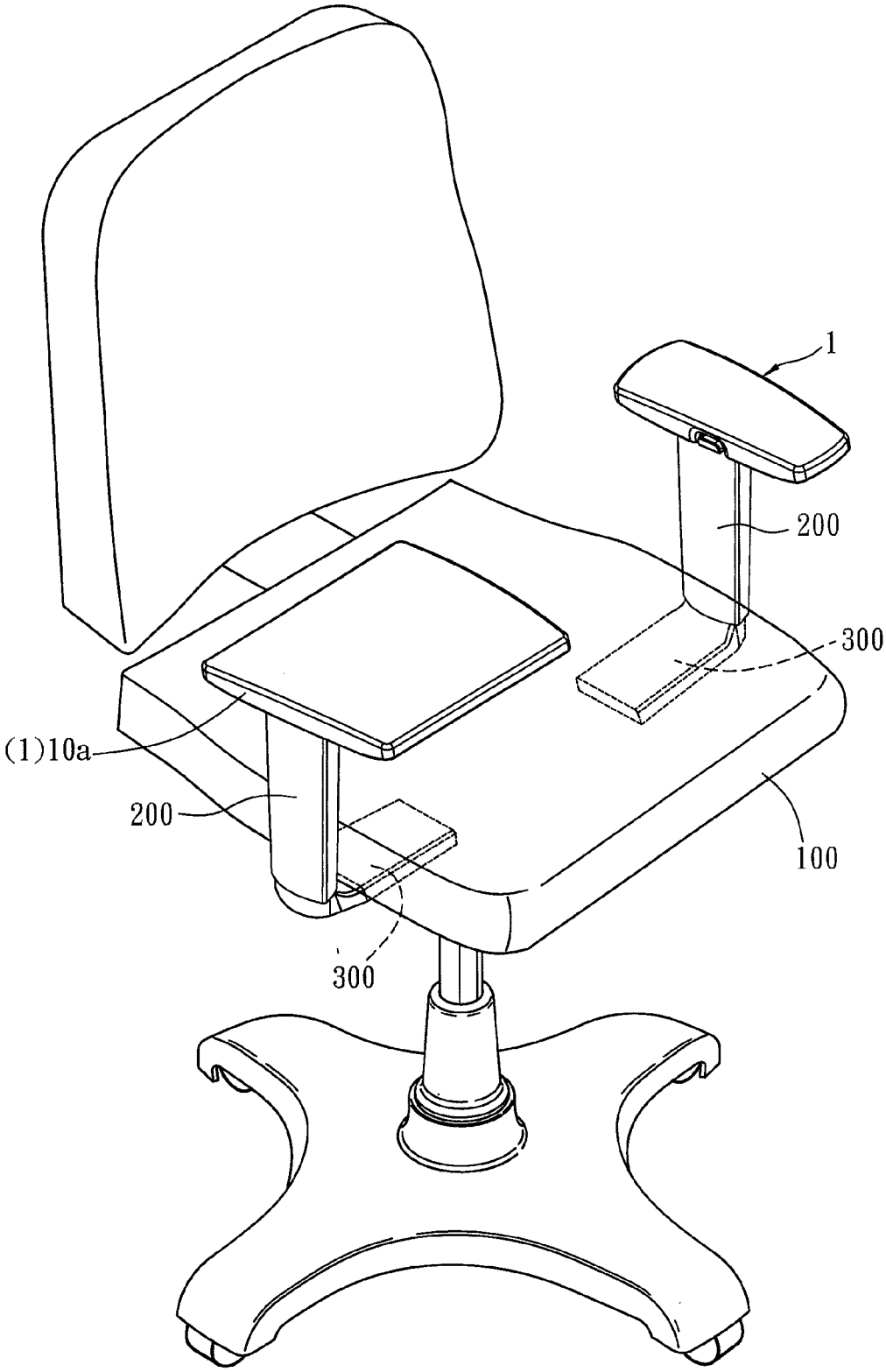
FIG. 16 is a schematic drawing showing a table-shaped armrest pad arranged at a chair seat of an embodiment according to the present invention.

Refer to FIG. 16, the armrest pad 10 of the armrest 1 can be designed into a table-shaped armrest pad 10*a*, connected with other components in the above embodiment one and two. Thus the armrest 1 with the table-shaped armrest pad 10*a* can also be adjusted horizontally in different directions.

In accordance with the above structure, while the armrest 1 of the present invention being moved forward/leftward and leftward/rightward, the movement having damping effects due to contact between two damping parts 30 respectively and the positioning member 53 of the first component 50/the positioning member 551 of the guiding block 55. Thus the movement of the armrest 1 is stable, smooth and quiet. Moreover, the displacement is controlled precisely by both the plurality of slots 54 of the first component 50 engaged with the projective body 44 on the open slot 43 of the press member 40 and the slots 61 of the second component 60 engaged with the projective body 71 of the adjustment member 70.

In addition, the armrest adjustment device of the present invention features on simple structure and fewer components. Thus the assembling time is much reduced, the operation is easy and the movement is quiet and smooth. These lead to great difference between the present invention and prior arts. Therefore, the functions of the present invention are improved, the production cost is reduced and the competitiveness is increased.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An armrest adjustment device comprising an armrest disposed on a top surface of an armrest support and a lower part of the armrest support is connected to a chair seat;

the armrest is able to be adjusted forward and backward in relation to the chair seat; wherein the armrest includes:

an armrest pad;

an armrest base assembled with the armrest pad to form an armrest body having a rectangular space therein; an opening is mounted on one side of the armrest; symmetrical slots are arranged at a middle part of the armrest base along the same direction of movement of the armrest; a gap is mounted on an inner side of the armrest base and is aligned with the opening; a mounting slot with a projecting piece on one side is arranged at the armrest base;

a first component mounted inside the armrest body; the first component is disposed with two posts, a positioning member and a plurality of grooves arranged at regular intervals; the two posts are respectively arranged at a front part and a rear part on a bottom surface of the first component; each of the two posts passes through one of the symmetrical slots on the middle part of the armrest base to be assembled with and fixed on the armrest support correspondingly;

a damping part that is mounted in the mounting slot of the armrest base and is against the positioning member for providing damping effects; and a press member passing the opening of the armrest base and mounted in the armrest body; a press part is on one end of the press member while an elastic part is arranged at the other side and the elastic part is elastically against the projecting piece on the side of the mounting slot of the armrest base; an open slot with an opening facing upwards is set between the press part and the elastic part; at least one projective body is disposed on a bottom of the open slot near the side of the elastic part while a channel is formed on the bottom of the open slot near the press part;

wherein when the press member is pressed and moved inward elastically, the groove of the first component is corresponding to the channel of the press member and is able to be moved along the channel;

wherein while the press member is released and moved outward elastically, the grooves of the first component are engaged with the at least one projective body of the press member.

2. The device as claimed in claim 1, wherein a sliding slot is formed on a bottom surface inside the gap on the inner side of the armrest base and is allowing the press member to slide therein.

3. The device as claimed in claim 1, wherein the mounting slot is arranged at a bottom surface of the armrest base.

4. The device as claimed in claim 1, wherein the armrest pad is table-shaped.

5. An armrest adjustment device comprising an armrest disposed on a top surface of an armrest support and a lower part of the armrest support is connected to a chair seat;

the armrest is able to be adjusted forward, backward, leftward and rightward in relation to the chair seat; wherein the armrest includes:

an armrest pad;

an armrest base assembled with the armrest pad to form an armrest body having a rectangular space therein; an opening is mounted on one side of the armrest; symmetrical slots are arranged at a middle part of the armrest base along the same direction of forward/backward movement of the armrest; a gap is mounted on an inner side of the armrest base and is aligned with the opening; the armrest base is further disposed with a receiving hole having a circular wall around the receiving hole and the receiving hole is used to mount an adjustment member; at least one projective body is disposed on a bottom of the adjustment member and two symmetrical lugs are arranged at an upper part of the adjustment member and are over the circular wall of the receiving hole;

a press member passing the opening to be mounted in the armrest body; the press member includes a press part on one end and a slanted guide groove on the other end thereof; the slanted guide groove is corresponding to and assembled with the lug of the adjustment member;

an open slot with an opening facing upwards is set between the press part and the slanted guide groove; at least one projective body is disposed on a bottom of the open slot near the side of the slanted guide groove and a channel is formed near the press part; an elastic part is arranged between the press member and the receiving hole and is elastically against both the press member and the circular wall of the receiving hole; the press member is moved horizontally due to the slanted guide groove so that the adjustment member is able to move vertically in relation to the press member;

a second component arranged under the armrest body and fixed on the armrest support; a plurality of slots arranged at regular intervals on a middle part of a top surface of the second component is engaged with the projective body of the adjustment member; a long groove is disposed on a front part and a rear part of the second component, along the left/right direction; a guiding slot penetrating from the left side to the right side and corresponding to each long groove is arranged at a bottom surface of the second component and a mounting slot is mounted on the second component;

a first component arranged inside the armrest body; a post is disposed on a front part and a rear part respectively on a bottom surface of the first component; the post passing through one of the symmetrical slots of the armrest base and the long groove of the second component is connected with a guiding block on a bottom end thereof; the guiding block is arranged with a positioning member and is in the guiding slot of the second component; the first component is further disposed with a positioning member and a plurality of grooves arranged at regular intervals; and two damping parts, respectively mounted in the mounting slot of the armrest base and the mounting slot of the second component, and against the positioning member of the first component and the positioning member of the guiding block for providing damping effects;

wherein when the press member is pressed and moved inward, the adjustment member is moved upward and the projective body of the adjustment member is separated from the slot of the second component; the grooves of the first component is corresponding to the channel of the press member and is able to be moved along the channel; the guiding block on the bottom end of the post of the first component is movable in the guiding slot;

wherein when the press member is moved outward, the adjustment member is moved downward so that the projective body of the adjustment member is engaged with the slot of the second component and the groove of the first component is locked with the projective body of the press member.

6. The device as claimed in claim 5, wherein the mounting slot of the second component is arranged at a bottom surface of the second component.

7. The device as claimed in claim 5, wherein the lug of the adjustment member is arranged with a slanted surface that is engaged with the slanted guide groove press member correspondingly.

8. The device as claimed in claim 5, wherein a threaded hole is arranged at a front part and a rear part of the second component; the second component is fastened on the armrest support by a bolt passing the threaded hole.

9. The device as claimed in claim 5, wherein the first component is further arranged with a long groove that allows the adjustment member moving upward freely; the long groove is arranged along the same direction as the armrest, forward or backward.

10. The device as claimed in claim 5, wherein a sliding slot is formed on a bottom surface inside the gap on the inner side of the armrest base and is allowing the press member to slide therein.

11. The device as claimed in claim 5, wherein the armrest pad is table-shaped.

* * * * *